US006901916B2

(12) United States Patent
Hashimoto et al.

(10) Patent No.: US 6,901,916 B2
(45) Date of Patent: Jun. 7, 2005

(54) FUEL DISCHARGE APPARATUS HAVING A VAPOR REMOVAL SYSTEM, AND INTERNAL COMBUSTION ENGINE FUEL SUPPLY SYSTEM HAVING SUCH FUEL DISCHARGE APPARATUS

(75) Inventors: Shogo Hashimoto, Kanagawa (JP); Ryoji Ehara, Kanagawa (JP); Hiroshi Mizui, Kanagawa (JP); Tadashi Nichogi, Kanagawa (JP)

(73) Assignee: Mikuni Corporation, Tokyo (JP)

( * ) Notice: Subject to any disclaimer, the term of this patent is extended or adjusted under 35 U.S.C. 154(b) by 0 days.

(21) Appl. No.: 10/765,189

(22) Filed: Jan. 28, 2004

(65) Prior Publication Data

US 2004/0182368 A1 Sep. 23, 2004

Related U.S. Application Data

(63) Continuation of application No. PCT/JP02/07469, filed on Jul. 24, 2002.

(30) Foreign Application Priority Data

Jul. 30, 2001 (JP) ..... 2001-229563

(51) Int. Cl.[7] ..... F02M 37/00
(52) U.S. Cl. ..... 123/516; 123/514
(58) Field of Search ..... 123/510, 516, 123/518, 519, 520, 521, 461, 514

(56) References Cited

U.S. PATENT DOCUMENTS 5,280,774 A 1/1994 Entenmann et al.
5,355,860 A * 10/1994 Ekstam ..... 123/516
5,579,740 A * 12/1996 Cotton et al. ..... 123/516
5,608,369 A 3/1997 Irgens et al.
5,730,106 A * 3/1998 Gonzalez ..... 123/516
5,855,197 A * 1/1999 Kato ..... 123/516
6,422,207 B1 * 7/2002 Kolb et al. ..... 123/461
6,622,709 B2 * 9/2003 Miller et al. ..... 123/516

FOREIGN PATENT DOCUMENTS

| | | |
|---|---|---|
| CA | 2218695 | 10/1996 |
| JP | 59-115405 | 8/1984 |
| JP | 60-180761 | 11/1985 |
| JP | 61-817 | 1/1986 |
| JP | 61-175565 | 11/1986 |
| JP | 1-83166 | 6/1989 |
| JP | 3-121254 | 5/1991 |
| JP | 5-157014 | 6/1993 |
| JP | 9-105366 | 4/1997 |

* cited by examiner

*Primary Examiner*—Weilun Lo
(74) *Attorney, Agent, or Firm*—Wenderoth, Lind & Ponack, L.L.P.

(57) ABSTRACT

An internal combustion engine fuel supply system includes a fuel discharge apparatus having a vapor removal system. The fuel discharge apparatus includes an apparatus body, a fuel chamber defined in the body, a fuel inlet connected to a fuel tank, a fuel supply path partially defined by the fuel inlet and connecting the fuel chamber to the fuel tank, a fuel discharge outlet, a fuel return outlet for return of excess fuel to the fuel tank, and a reflux path connecting the fuel supply path to the fuel return outlet. A vapor blocking member is provided in the fuel supply path at a bifurcation point at which the reflux path branches from the fuel supply path. The reflux path is arranged such that vapor blocked by the vapor blocking member rises from the bifurcation point and through the reflux path to the fuel return outlet due to self-buoyancy of the vapor.

66 Claims, 5 Drawing Sheets

FUEL DISCHARGE APPARATUS HAVING A VAPOR REMOVAL SYSTEM, AND INTERNAL COMBUSTION ENGINE FUEL SUPPLY SYSTEM HAVING SUCH FUEL DISCHARGE APPARATUS

This is a continuation application of international application PCT/JP02/07469, filed Jul. 24, 2002.

BACKGROUND OF THE INVENTION

1. Field of the Invention

The present invention pertains to a vapor removal apparatus for a fuel supply system used in an internal combustion engine.

2. Description of the Related Art

As an internal combustion engine, an engine equipped with a fixed Venturi-type vaporizer 1 such as that shown in FIG. 5, for example, is known in the conventional art.

A fuel supply system that supplies fuel F held in a fuel tank 2 to the vaporizer 1 is mounted to the vaporizer 1.

The fuel supply system is equipped with a fuel supply path 4 that fluidically connects the fuel tank 2 with a float chamber 3 mounted to the vaporizer 1, and a fuel pump 5 coupled in the fuel supply path 4 to supply the fuel F from the fuel tank 2 to the float chamber 3.

In this type of fuel supply system, when the fuel F is sucked into the fuel pump 5, air bubbles may be generated in the suctioned fuel F due to negative pressure.

These air bubbles include vapor generated in the fuel F due to the increase in ambient temperature which accompanies the heating up of the engine. The term "vapor" refers generically to non-liquid gaseous material such as air bubbles and fuel vapor.

When the air bubbles and vapor are generated in this way, it is assumed that they will be supplied to the vaporizer 1 via the float chamber 3 together with the fuel F. When the fuel F in which the air bubbles and vapor are mixed is supplied to the vaporizer 1, the following problems occur: (1) an unstable air/fuel ratio in the air-fuel mixture generated in the vaporizer 1, and (2) difficulty in restarting the engine.

Accordingly, in an internal combustion engine in which a large amount of vapor or air bubbles are generated because the thermal ambient conditions are poor, or because the engine is susceptible to vibration, a vapor separation tank 6 that temporarily holds the fuel F sent from the fuel pump 5 is located downstream of the fuel pump 5 at a point in the fuel supply path 4, such that in this vapor separation tank 6, the vapor and air bubbles are separated so as to rise to the top of the vapor separation tank 6 due to their buoyancy, and the vapor and air bubbles are expelled toward the fuel tank 2 via the vapor return path 7 located at the top of the vapor separation tank 6.

However, in this conventional type of fuel supply system for an internal combustion engine, the following problem requiring correction remains.

That is, while the fuel F is being held in the vapor separation tank 6, the vapor and air bubbles are separated using their own buoyancy, but when the vapor separation tank 6 is shaken by engine vibration or for some other reason, the fuel F being held in the vapor separation tank 6 is churned. As a result, the vapor and air bubbles are not separated, and therefore, the vapor and air bubbles end up being sent into the vaporizer 1 together with the fuel F.

SUMMARY OF THE INVENTION

The present invention was created in view of the problems that arise in the conventional art, and an object of the present invention is to provide a vapor removal apparatus for a fuel supply system in an internal combustion engine that can reliably remove the vapor generated in the fuel system by guiding it to the fuel tank.

In order to resolve the problems described above in an internal combustion engine fuel supply system according to the present invention a fuel supply passage fluidically connects a fuel supply apparatus to a fuel tank and a vapor return path branches off from the fuel supply passage and is connected to the fuel tank. A surface tension generating member is provided at a bifurcation point where the vapor return path branches off from the fuel supply passage, so as to cover an opening leading to the fuel supply apparatus and thereby serve as a vapor blocking member.

According to an embodiment of the present invention, a vapor separation tank that temporarily holds fuel supplied from the fuel tank is provided at the bifurcation point, the vapor return path is connected to the top of this vapor separation tank, an opening leading to the fuel supply apparatus is formed at the bottom of the vapor separation tank, and the surface tension generating member is provided so as to cover this opening. The fuel supply apparatus comprises a vaporizer, and the fuel supply path from the bifurcation point is connected to a float chamber in the vaporizer.

According to another embodiment of the present invention, the fuel supply apparatus is embodied as a fuel discharge apparatus that is operable to discharge (e.g., inject) fuel into an engine cylinder. The fuel discharge apparatus is arranged in a fuel supply system for an internal combustion system that includes a fuel tank, the fuel discharge apparatus, a fuel supply passage connecting the fuel discharge apparatus to the fuel tank to enable supply of fuel from the fuel tank to the fuel discharge apparatus, and a return passage connecting the fuel tank to the fuel discharge apparatus to enable return of excess fuel from the fuel discharge apparatus to the fuel tank.

The fuel discharge apparatus preferably comprises: a fuel discharge apparatus body; a fuel chamber defined within the fuel discharge apparatus body; a fuel inlet fluidically connected to the fuel tank; a fuel supply path at least partially defined by the fuel inlet and fluidically connected to the fuel chamber to supply fuel from the fuel tank to the fuel chamber; a fuel discharge outlet fluidically connected to the fuel chamber for discharging fuel from the fuel chamber; a fuel return outlet fluidically connected to the fuel tank via the return passage to allow return of excess fuel to the fuel tank; a reflux path defined in the fuel discharge apparatus body and being fluidically connected between the fuel supply path and the fuel return outlet to allow flow of the excess fuel from the fuel supply path to the fuel return outlet, the reflux path being connected to the fuel supply path at a bifurcation point; and a vapor blocking member provided in the fuel supply path at the bifurcation point to block entry of vapor into the fuel chamber; wherein the reflux path is arranged such that the vapor blocked by the vapor blocking member rises from the bifurcation point and through the reflux path to the fuel return outlet due to self-buoyancy of the vapor.

The fuel return outlet of the fuel discharge apparatus is preferably disposed vertically above the bifurcation point.

A fuel pump is preferably operably coupled in the fuel supply passage so as to be located downstream of the fuel tank and upstream of the bifurcation point.

An inlet check valve is preferably disposed in the fuel supply path between the bifurcation point and the fuel chamber.

A plunger pump is preferably disposed in the fuel discharge apparatus body, the plunger pump comprising a cylinder mounted in the fuel discharge apparatus body, a plunger slidably disposed in the cylinder for reciprocating movement therein, and a solenoid coil disposed around the cylinder for actuating the plunger to slide within the cylinder; and the reflux path preferably extends in an axial direction of the plunger pump between the cylinder and the solenoid coil.

The reflux path is preferably connected to the fuel supply path at a bifurcation point in such a manner that the reflux path branches off from the fuel supply path at the bifurcation point and originates at the fuel supply path and leads from the fuel supply path to the fuel return outlet.

A fuel injection nozzle is preferably provided at the fuel discharge outlet, and a plunger pump is preferably disposed in the fuel discharge apparatus body and operably connected with the fuel chamber to pressurize fuel in the fuel chamber to thereby enable discharge of the fuel from the fuel discharge outlet through the fuel injection nozzle.

The bifurcation point is preferably disposed within the fuel discharge apparatus body.

The vapor blocking member preferably comprises a surface tension generating member, and the suitable materials from which the tension generating member can be formed include a porous paper sheet, a perforated metal plate, a sintered body having continuous pores, and a non-woven fabric.

DETAILED DESCRIPTION OF THE PREFERRED EMBODIMENTS

Embodiments of the present invention will be described below with reference to FIGS. 1–4.

Figure 1:
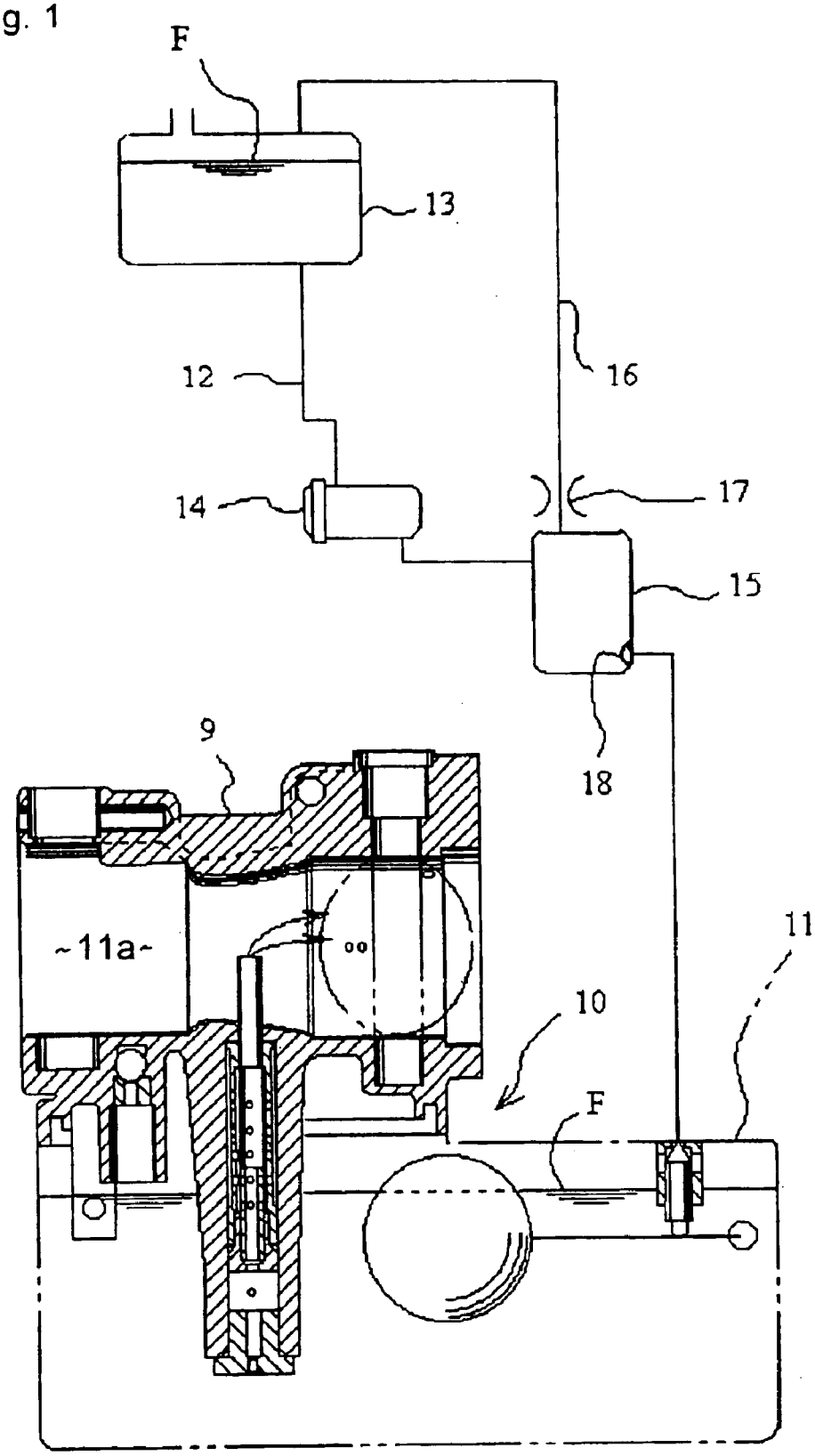
FIG. 1 is a schematic structural drawing of a fuel supply system according to a first embodiment of the present invention.

FIG. 1 shows an internal combustion engine fuel supply system according to a first embodiment of the present invention. A vaporizer 10 serves as a fuel supply apparatus to supply an air-fuel mixture to the internal combustion engine. The vaporizer 10 is equipped with a main body 9 in which is formed an air intake path 11*a*.

A float chamber 11 that holds fuel F is located below the main body 9, and a fuel tank 13 is connected to the float chamber 11 via a fuel supply path 12.

Partway down the fuel supply path 12 is located a fuel pump 14 that sends the fuel F held in the fuel tank 13 to the float chamber 11 of the vaporizer 10. A vapor separation tank 15 is located between the fuel pump 14 and the float chamber 11 and serves to temporarily hold the fuel F sent to the float chamber.

The fuel pump 14 is connected to the vapor separation tank 15 at a top part thereof, while the float chamber 11 is connected to the vapor separation tank 15 at a bottom part thereof.

Furthermore, a vapor return path 16 is connected to a top part of the vapor separation tank 15 so as to fluidically connect the vapor separation tank 15 to an empty space in a top portion of the fuel tank 13.

In the vapor return path 16, the vapor and air bubbles separated from the fuel F in the vapor separation tank 15 are expelled toward the fuel tank 13 due to their own buoyancy, and the residual fuel F passing through a restriction 17 located along the return path 16 is returned to the fuel tank 13.

Also, in this embodiment, a surface tension generating member 18 is located at a bifurcation point at which the return path 16 branches off from the fuel supply path 12 so as to cover an opening that is formed in the vapor separation tank 15 and leads to the fuel supply apparatus (i.e., the vaporizer 10).

The surface tension generating member 18 is a sheet comprising, for example, a porous paper sheet, a perforated metal plate, such as a punched plate or a screen, or a porous sintered body or nonwoven fabric.

The surface tension generating member 18 will be described in detail below with reference to FIGS. 2A–2C.

Figure 2A:
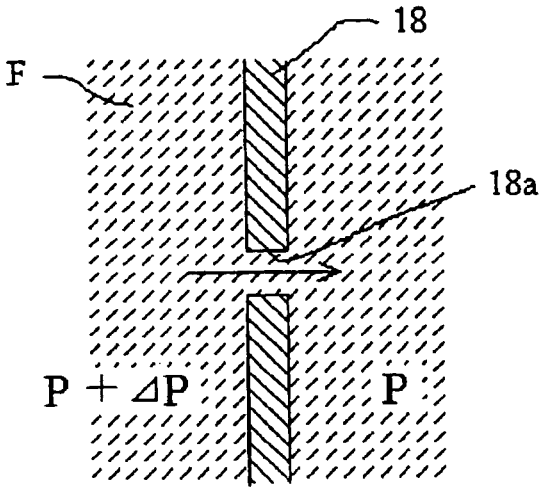
FIGS. 2A–2C are drawings to explain the operation of a surface tension generating member according to the present invention.

The surface tension generating member 18 has numerous pores 18*a* (one of which is shown in FIG. 2A), and the fuel F passes through these pores 18*a*.

As shown in FIG. 2A, where both sides of the surface tension generating member 18 are permeated by the fuel F, the fuel F is caused to pass through the pores 18*a* of the surface tension generating member 18 due to the difference in pressure $\Delta P$ between the pressure at the upstream side of the surface tension generating member 18 and the pressure at the downstream side thereof, as shown in FIG. 2A.

Figure 2B:
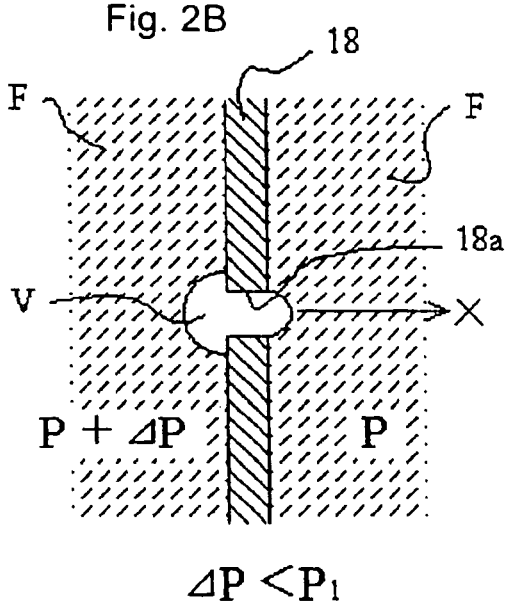

On the other hand, where vapor V has entered a pore 18*a*, as shown in FIG. 2B, a liquid surface is formed by the fuel F on the downstream side of the pore 18*a*, surface tension is generated on this liquid surface, and this surface tension creates resistance to prevent the vapor V from passing through the pore 18*a*.

For the vapor V to pass through the surface tension generating member 18, the pressure difference $\Delta P$ must equal or exceed the expulsion pressure P1 that is necessary to overcome the surface tension.

Figure 2C:
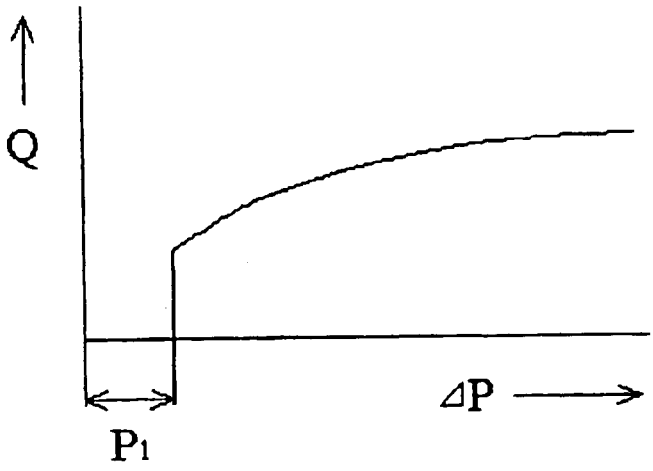

Accordingly, as shown in FIG. 2C, when the pressure difference $\Delta P$ between the two sides of the surface tension generating member 18 is in a smaller range than the expulsion pressure P1, the vapor V does not pass through the surface tension generating member 18, and only the fuel F passes through the surface tension generating member 18. Thus, the surface tension generating member 18 serves as a vapor blocking member that allows flow of fuel therethrough but inhibits or prevents flow of vapor therethrough at least under prescribed conditions.

In FIG. 2C, Q is the quantity of vapor (e.g., air) passing through the surface tension generating member 18.

Accordingly, in this embodiment, even where air bubbles become mixed into the fuel F due to vibration or the like at the bifurcation point at which the vapor return path 16 branches off from the fuel supply path 12, i.e., in the vapor separation tank 15, and the air bubbles reach the opening leading to the vaporizer 10, the air bubbles are prevented from entering the vaporizer 10 due to the operation of the surface tension generating member 18.

Figure 3:
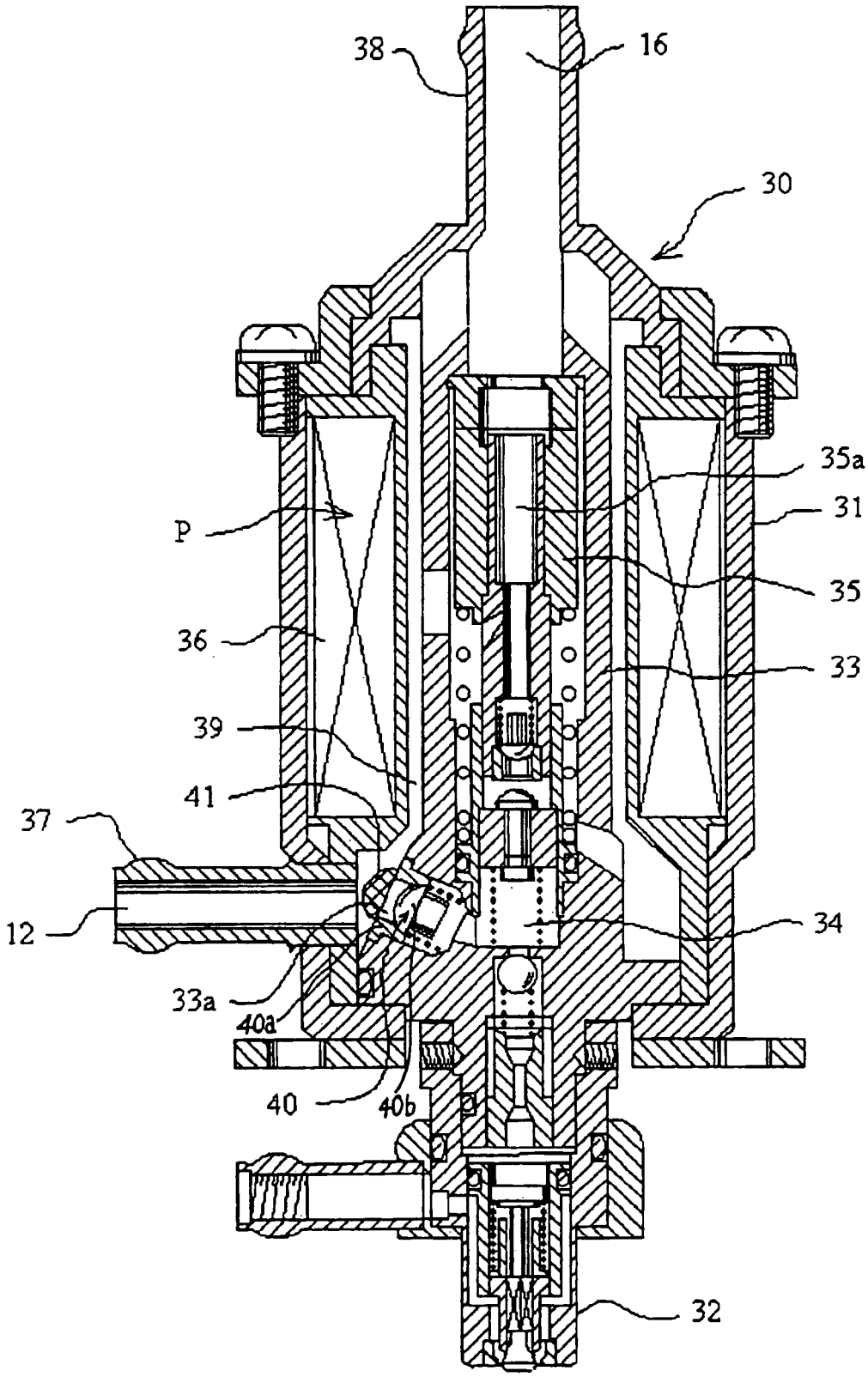
FIG. 3 is a vertical cross-sectional view of a fuel supply apparatus according to a second embodiment of the present invention.

FIG. 3 shows a second embodiment of the present invention, wherein a fuel injection apparatus 30 is used as the fuel supply (discharge) apparatus described above, and wherein a reflux path 39 branches off from the fuel supply path 12 at a bifurcation point and leads to a return passage 16. The bifurcation point is located within the fuel injection apparatus 30.

To describe this arrangement in detail, the fuel injection apparatus 30 includes a body 31, a plunger pump P that is mounted inside the body 31 and draws the fuel F in by suction created in a suction stroke and conveys the fuel F by pressure created in a return stroke, and an injection nozzle 32 that is mounted inside the body 31 and injects the fuel F. The plunger pump P comprises a cylinder 33, a plunger 35 that is slidably mounted inside the cylinder 33 to form a pressure chamber (fuel chamber) 34, and a solenoid coil 36 that magnetizes the plunger 35. A suction contact pipe (fuel inlet) 37 that forms at least a portion of the fuel supply path 12 is located at the bottom of the body 31, a return contact pipe (return outlet) 38 that forms at least a portion of the return path 16 is located at the top of the body 31, and the reflux path 39 that guides a part of the fuel that has branched off from the fuel supply path 12 to the return passage 16 via the return outlet 38 is located between the cylinder 33 and the solenoid coil 36.

In addition, a suction path 33*a* that connects the fuel inlet 37 with the pressure chamber 34 and constitutes part of the fuel supply path 12 is formed at the bottom end of the cylinder 33, at the bifurcation point at which the reflux path 39 branches off from the fuel supply path 12. An inlet check valve 40 that operates to permit the fuel F to flow into the pressure chamber 34 only when the plunger 35 is performing a suction stroke is formed partway along the suction path 33*a*.

In this embodiment, a surface tension generating member 41 is located so as to span across the suction path 33*a* at its entrance side (i.e., upstream of the inlet check valve 40). For example, as shown in FIG. 3, the surface generating member 41 is preferably mounted so as to cover an upstream opening of a valve body 40*a* of the inlet check valve 40 that forms a valve seat for a valve member 40*b* of the inlet check valve 40.

In the fuel injection apparatus 30 having the construction described above, the fuel F is sucked into the pressure chamber 34 via the inlet check valve 40 as the plunger 35 moves up and down. The up-and-down (reciprocating) plunger movement also serves to send the fuel F into the injection nozzle 32 and eject the fuel from the injection nozzle 32.

When vapor is mixed in the fuel F supplied from the fuel inlet 37, the vapor flows into the reflux path 39 due to its own buoyancy and is guided to the fuel tank 13 via the return path 16.

Here, even if the vapor is made to flow toward the suction path 33*a*, it is prevented from entering the suction path 33*a* by the surface tension generating member 41, and as a result, vapor is prevented from mixing into the fuel that is to be injected via the injection nozzle 32.

The various configurations and sizes of the various constituent elements shown in the embodiments described above are examples only, and various modifications may be made in accordance with design requirements.

Figure 4:
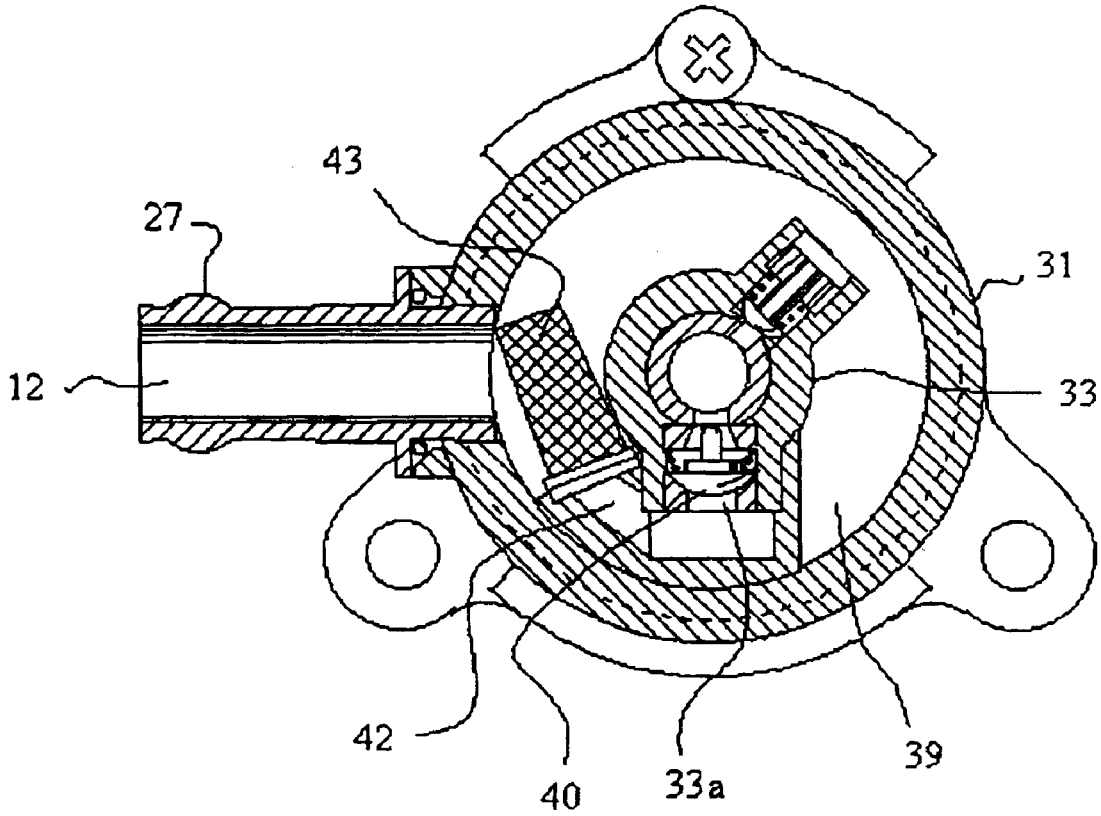
FIG. 4 is a horizontal cross-sectional view of a fuel supply apparatus according to a variation of the second embodiment of the present invention.
Figure 5:
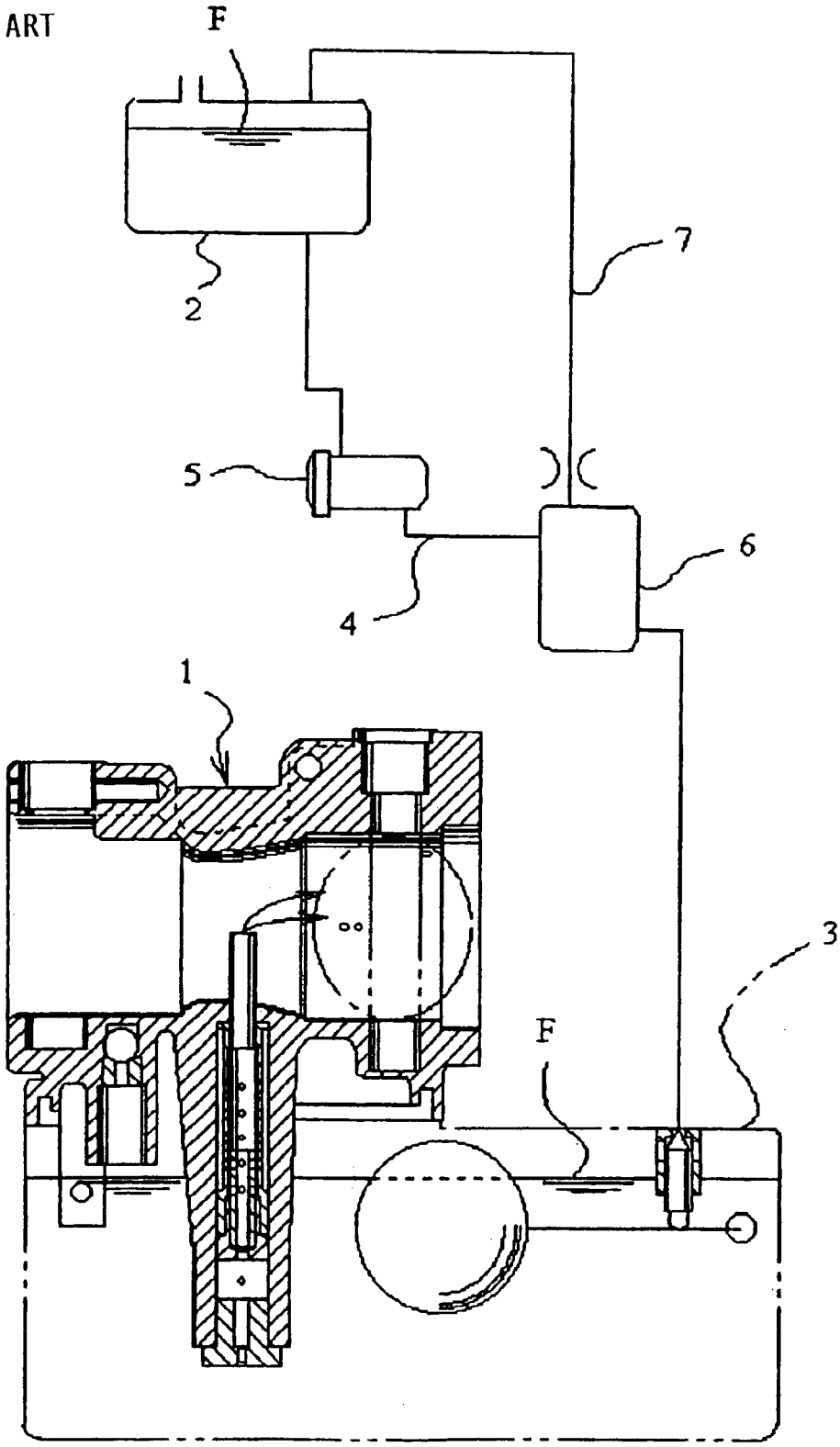
Fig. 5 PRIOR ART
FIG. 5 is a schematic structural drawing showing an example of a conventional fuel supply system.

For example, in the second embodiment described above, an example was used in which the surface tension generating member 41 covered the opening to the suction path 33*a*, but it is also acceptable if a guide path 42 connected to the suction path 33*a* is formed at a tangent to the cylinder 33 and a surface tension generating member 43 is located so as to cover the opening at the end of the guide path 42, as shown in FIG. 4.

Using this construction, the mounting location of the surface tension generating member 43 can be set arbitrarily, or the surface tension generating member 43 can be mounted at a wide part of the reflux path 39, and thus, the arrangement of the surface tension generating member 43 can be easily determined, and it can be easily mounted.

As described above, in the vapor removal apparatus for a fuel supply system in an internal combustion engine according to the present invention, when vapor (including, for example, fuel vapor or air bubbles) is mixed into the fuel supplied to the fuel supply apparatus, the fuel vapor and air bubbles can be prevented from passing through and entering the fuel supply apparatus by a surface tension generating apparatus, while an adequate amount of fuel supply is maintained.

Furthermore, even when the fuel sent to the fuel supply apparatus is churned due to vibration or the like such that the fuel vapor and air bubbles cannot be separated from the fuel by means of their buoyancy, the entry of the fuel vapor and air bubbles into the fuel supply apparatus can be prevented.

What is claimed is:

1. A fuel discharge apparatus for use in a fuel supply system of an internal combustion engine, said fuel discharge apparatus comprising:

a fuel discharge apparatus body;

a fuel chamber defined within said fuel discharge apparatus body;

a fuel inlet adapted to be fluidically connected to a fuel tank;

a fuel supply path at least partially defined by said fuel inlet and fluidically connected to said fuel chamber to supply fuel from the fuel tank to said fuel chamber;

a fuel discharge outlet fluidically connected to said fuel chamber for discharging fuel from said fuel chamber;

a fuel return outlet adapted to be fluidically connected to the fuel tank to allow return of excess fuel to the fuel tank;

a reflux path defined in said fuel discharge apparatus body and being fluidically connected between said fuel supply path and said fuel return outlet to allow flow of the excess fuel from said fuel supply path to said fuel return outlet, said reflux path being connected to said fuel supply path at a bifurcation point;

a vapor blocking member provided in said fuel supply path at said bifurcation point to block entry of vapor into said fuel chamber; and an inlet check valve disposed in said fuel supply path between said bifurcation point and said fuel chamber;

wherein said reflux path is arranged such that the vapor blocked by said vapor blocking member rises from said bifurcation point and through said reflux path to said fuel return outlet due to self-buoyancy of the vapor.

2. A fuel discharge apparatus according to claim 1, wherein said fuel return outlet is disposed vertically above said bifurcation point.

3. A fuel supply system for an internal combustion engine, said fuel supply system including a fuel tank, a fuel discharge apparatus, a fuel supply passage connecting said fuel discharge apparatus to said fuel tank to enable supply of fuel from said fuel tank to said fuel discharge apparatus and a return passage connecting said fuel tank to said fuel discharge apparatus to enable return of excess fuel from said fuel discharge apparatus to said fuel tank, said fuel discharge apparatus comprising:

a fuel discharge apparatus body;

a fuel chamber defined within said fuel discharge apparatus body;

a fuel inlet fluidically connected to said fuel tank;

a fuel supply path at least partially defined by said fuel inlet and fluidically connected to said fuel chamber to supply fuel from said fuel tank to said fuel chamber;

a fuel discharge outlet fluidically connected to said fuel chamber for discharging fuel from said fuel chamber;

a fuel return outlet fluidically connected to said fuel tank via said return passage to allow return of excess fuel to said fuel tank;

a reflux path defined in said fuel discharge apparatus body and being fluidically connected between said fuel supply path and said fuel return outlet to allow flow of the excess fuel from said fuel supply path to said fuel return outlet, said reflux path being connected to said fuel supply path at a bifurcation point;

a vapor blocking member provided in said fuel supply path at said bifurcation point to block entry of vapor into said fuel chamber; and a plunger pump disposed in said fuel discharge apparatus body, said plunger pump comprising a cylinder mounted in said fuel discharge apparatus body, a plunger slidably disposed in said cylinder for reciprocating movement therein, and a solenoid coil disposed around said cylinder for actuating said plunger to slide within said cylinder, wherein said reflux path extends in an axial direction of said plunger pump between said cylinder and said solenoid coil; and wherein said reflux path is arranged such that the vapor blocked by said vapor blocking member rises from said bifurcation point and through said reflux path to said fuel return outlet due to self-buoyancy of the vapor.

4. A fuel discharge apparatus for use in a fuel supply system of an internal combustion engine, said fuel discharge apparatus comprising:

a fuel discharge apparatus body;

a fuel chamber defined within said fuel discharge apparatus body;

a fuel inlet adapted to be fluidically connected to a fuel tank;

a fuel supply path at least partially defined by said fuel inlet and fluidically connected to said fuel chamber to supply fuel from the fuel tank to said fuel chamber;

a fuel discharge outlet fluidically connected to said fuel chamber for discharging fuel from said fuel chamber;

a fuel return outlet adapted to be fluidically connected to the fuel tank to allow return of excess fuel to the fuel tank;

a reflux path defined in said fuel discharge apparatus body and being fluidically connected between said fuel supply path and said fuel return outlet to allow flow of the excess fuel from said fuel supply path to said fuel return outlet, said reflux path being connected to said fuel supply path at a bifurcation point;

a vapor blocking member provided in said fuel supply path at said bifurcation point to block entry of vapor into said fuel chamber; and a plunger pump disposed in said fuel discharge apparatus body, said plunger pump comprising a cylinder mounted in said fuel discharge apparatus body, a plunger slidably disposed in said cylinder for reciprocating movement therein, and a solenoid coil disposed around said cylinder for actuating said plunger to slide within said cylinder;

wherein said reflux path extends in an axial direction of said plunger pump between said cylinder and said and solenoid coil; and wherein said reflux path is arranged such that the vapor blocked by said vapor blocking member rises from said bifurcation point and through said reflux path to said fuel return outlet due to self-buoyancy of the vapor.

5. A fuel discharge apparatus according to claim 1, wherein said reflux path is connected to said fuel supply path at a bifurcation point in such a manner that said reflux path branches off from said fuel supply path at said bifurcation point and originates at said fuel supply path and leads from said fuel supply path to said fuel return outlet.

6. A fuel discharge apparatus according to claim 1, further comprising a fuel injection nozzle provided at said fuel discharge outlet.

7. A fuel discharge apparatus according to claim 6, further comprising a plunger pump disposed in said fuel discharge apparatus body and operably connected with said fuel chamber to pressurize fuel in said fuel chamber to thereby enable discharge of the fuel from said fuel discharge outlet through said fuel injection nozzle.

8. A fuel discharge apparatus according to claim 1, wherein said bifurcation point is disposed within said fuel discharge apparatus body.

9. A fuel discharge apparatus according to claim 1, wherein said vapor blocking member comprises a surface tension generating member.

10. A fuel discharge apparatus according to claim 9, wherein said surface tension generating member comprises a porous paper sheet.

11. A fuel discharge apparatus according to claim 9, wherein said surface tension generating member comprises a perforated metal plate.

12. A fuel discharge apparatus according to claim 9, wherein said surface tension generating member comprises a porous sintered body.

13. A fuel discharge apparatus according to claim 9, wherein said surface tension generating member comprises a non-woven fabric.

14. A fuel discharge apparatus for use in a fuel supply system of an internal combustion engine, said fuel discharge apparatus comprising:

a fuel discharge apparatus body;

a fuel chamber defined within said fuel discharge apparatus body;

a fuel inlet adapted to be fluidically connected to a fuel tank;

a fuel supply path at least partially defined by said fuel inlet and fluidically connected to said fuel chamber to supply fuel from the fuel tank to said fuel chamber;

a fuel discharge outlet fluidically connected to said fuel chamber for discharging fuel from said fuel chamber;

a fuel return outlet adapted to be fluidically connected to the fuel tank to allow return of excess fuel to the fuel tank;

a reflux path defined in said fuel discharge apparatus body and being fluidically connected between said fuel supply path and said fuel return outlet to allow flow of the excess fuel from said fuel supply path to said fuel return outlet, said reflux path being connected to said fuel supply path at a bifurcation point;

a vapor blocking member provided in said fuel supply path at said bifurcation point to block entry of vapor into said fuel chamber; and an inlet check value disposed in said fuel supply path between said bifurcation point and said fuel chamber.

15. A fuel discharge apparatus according to claim 14, further comprising a plunger pump disposed in said fuel discharge apparatus body, said plunger pump comprising a cylinder mounted in said fuel discharge apparatus body, a plunger slidably disposed in said cylinder for reciprocating movement therein, and a solenoid coil disposed around said cylinder for actuating said plunger to slide within said cylinder; and wherein said reflux path extends in an axial direction of said plunger pump between said cylinder and said solenoid coil.

16. A fuel discharge apparatus according to claim 14, wherein said reflux path is connected to said fuel supply path at a bifurcation point in such a manner that said reflux path branches off from said fuel supply path at said bifurcation point and originates at said fuel supply path and leads from said fuel supply path to said fuel return outlet.

17. A fuel discharge apparatus according to claim 14, further comprising a fuel injection nozzle provided at said fuel discharge outlet.

18. A fuel discharge apparatus according to claim 17, further comprising a plunger pump disposed in said fuel discharge apparatus body and operably connected with said fuel chamber to pressurize fuel in said fuel chamber to thereby enable discharge of the fuel from said fuel discharge outlet through said fuel injection nozzle.

19. A fuel discharge apparatus according to claim 14, wherein said bifurcation point is disposed within said fuel discharge apparatus body.

20. A fuel discharge apparatus according to claim 14, wherein said vapor blocking member comprises a surface tension generating member.

21. A fuel discharge apparatus for use in a fuel supply system of an internal combustion engine, said fuel discharge apparatus comprising:

a fuel discharge apparatus body;

a fuel chamber defined within said fuel discharge apparatus body;

a fuel inlet adapted to be fluidically connected to a fuel tank;

a fuel supply path at least partially defined by said fuel inlet and fluidically connected to said fuel chamber to supply fuel from the fuel tank to said fuel chamber;

a fuel discharge outlet fluidically connected to said fuel chamber for discharging fuel from said fuel chamber;

a fuel return outlet adapted to be fluidically connected to the fuel tank to allow return of excess fuel to the fuel tank;

a reflux path defined in said fuel discharge apparatus body and being fluidically connected between said fuel supply path and said fuel return outlet to allow flow of the excess fuel from said fuel supply path to said fuel return outlet, said reflux path being connected to said fuel supply path at a bifurcation point;

a vapor blocking member provided in said fuel supply path at said bifurcation point to block entry of vapor into said fuel chamber; and a plunger pump disposed in said fuel discharge apparatus body, said plunger pump comprising a cylinder mounted in said fuel discharge apparatus body, a plunger slidably disposed in said cylinder for reciprocating movement therein, and a solenoid coil disposed around said cylinder for actuating said plunger to slide within said cylinder;

wherein said reflux path extends in an axial direction of said plunger pump between said cylinder and said solenoid coil.

22. A fuel discharge apparatus according to claim 21, wherein said reflux path is connected to said fuel supply path at a bifurcation point in such a manner that said reflux path branches off from said fuel supply path at said bifurcation point and originates at said fuel supply path and leads from said fuel supply path to said fuel return outlet.

23. A fuel discharge apparatus according to claim 21, further comprising a fuel injection nozzle provided at said fuel discharge outlet.

24. A fuel discharge apparatus according to claim 23, wherein said plunger pump is operably connected with said fuel chamber to pressurize fuel in said fuel chamber to thereby enable discharge of the fuel from said fuel discharge outlet through said fuel injection nozzle.

25. A fuel discharge apparatus according to claim 21, wherein said bifurcation point is disposed within said fuel discharge apparatus body.

26. A fuel discharge apparatus according to claim 21, wherein said vapor blocking member comprises a surface tension generating member.

27. A fuel supply system according to claim 3, wherein said reflux path is connected to said fuel supply path at a bifurcation point in such a manner that said reflux path branches off from said fuel supply path at said bifurcation point and originates at said fuel supply path and leads from said fuel supply path to said fuel return outlet.

28. A fuel supply system according to claim 3, further comprising a fuel injection nozzle provided at said fuel discharge outlet.

29. A fuel supply system according to claim 3, wherein said bifurcation point is disposed within said fuel discharge apparatus body.

30. A fuel supply system according to claim 3, wherein said vapor blocking member comprises a surface tension generating member.

31. A fuel discharge apparatus according to claim 4, wherein said reflux path is connected to said fuel supply path at a bifurcation point in such a manner that said reflux path branches off from said fuel supply path at said bifurcation point and originates at said fuel supply path and leads from said fuel supply path to said fuel return outlet.

32. A fuel discharge apparatus according to claim 4, further comprising a fuel injection nozzle provided at said fuel discharge outlet.

33. A fuel discharge apparatus according to claim 4, wherein said bifurcation point is disposed within said fuel discharge apparatus body.

34. A fuel discharge apparatus according to claim 4, wherein said vapor blocking member comprises a surface tension generating member.

35. A fuel supply system for an internal combustion engine, said fuel supply system including a fuel tank, a fuel discharge apparatus, a fuel supply passage connecting said fuel discharge apparatus to said fuel tank to enable supply of fuel from said fuel tank to said fuel discharge apparatus and a return passage connecting said fuel tank to said fuel discharge apparatus to enable return of excess fuel from said fuel discharge apparatus to said fuel tank, said fuel discharge apparatus comprising:

a fuel discharge apparatus body;

a fuel chamber defined within said fuel discharge apparatus body;

a fuel inlet fluidically connected to said fuel tank;

a fuel supply path at least partially defined by said fuel inlet and fluidically connected to said fuel chamber to supply fuel from said fuel tank to said fuel chamber;

a fuel discharge outlet fluidically connected to said fuel chamber for discharging fuel from said fuel chamber;

a fuel return outlet fluidically connected to said fuel tank via said return passage to allow return of excess fuel to said fuel tank;

a reflux path defined in said fuel discharge apparatus body and being fluidically connected between said fuel supply path and said fuel return outlet to allow flow of the excess fuel from said fuel supply path to said fuel return outlet, said reflux path being connected to said fuel supply path at a bifurcation point;

a vapor blocking member provided in said fuel supply path at said bifurcation point to block entry of vapor into said fuel chamber; and an inlet check value disposed in said fuel supply path between said bifurcation point and said fuel chamber;

wherein said reflux path is arranged such that the vapor blocked by said vapor blocking member rises from said bifurcation point and through said reflux path to said fuel return outlet due to self-buoyancy of the vapor.

36. A fuel supply system according to claim 35, wherein said fuel return outlet is disposed vertically above said bifurcation point.

37. A fuel supply system according to claim 35, wherein said reflux path is connected to said fuel supply path at a bifurcation point in such a manner that said reflux path branches off from said fuel supply path at said bifurcation point and originates at said fuel supply path and leads from said fuel supply path to said fuel return outlet.

38. A fuel supply system according to claim 35, further comprising a fuel injection nozzle provided at said fuel discharge outlet.

39. A fuel supply system according to claim 38, further comprising a plunger pump disposed in said fuel discharge apparatus body and operably connected with said fuel chamber to pressurize fuel in said fuel chamber to thereby enable discharge of the fuel from said fuel discharge outlet through said fuel injection nozzle.

40. A fuel supply system according to claim 35, wherein said bifurcation point is disposed within said fuel discharge apparatus body.

41. A fuel supply system according to claim 35, wherein said vapor blocking member comprises a surface tension generating member.

42. A fuel supply system according to claim 41, wherein said surface tension generating member comprises a porous paper sheet.

43. A fuel supply system according to claim 41, wherein said surface tension generating member comprises a perforated metal plate.

44. A fuel supply system according to claim 41, wherein said surface tension generating member comprises a porous sintered body.

45. A fuel supply system according to claim 41, wherein said surface tension generating member comprises a non-woven fabric.

46. A fuel supply system for an internal combustion engine, said fuel supply system including a fuel tank, a fuel discharge apparatus, a fuel supply passage connecting said fuel discharge apparatus to said fuel tank to enable supply of fuel from said fuel tank to said fuel discharge apparatus and a return passage connecting said fuel tank to said fuel discharge apparatus to enable return of excess fuel from said fuel discharge apparatus to said fuel tank, said fuel discharge apparatus comprising:

a fuel discharge apparatus body;

a fuel chamber defined within said fuel discharge apparatus body;

a fuel inlet fluidically connected to said fuel tank;

a fuel supply path at least partially defined by said fuel inlet and fluidically connected to said fuel chamber to supply fuel from said fuel tank to said fuel chamber;

a fuel discharge outlet fluidically connected to said fuel chamber for discharging fuel from said fuel chamber;

a fuel return outlet fluidically connected to said fuel tank via said return passage to allow return of excess fuel to said fuel tank;

a reflux path defined in said fuel discharge apparatus body and being fluidically connected between said fuel supply path and said fuel return outlet to allow flow of the excess fuel from said fuel supply path to said fuel return outlet, said reflux path being connected to said fuel supply path at a bifurcation point;

a vapor blocking member provided in said fuel supply path at said bifurcation point to block entry of vapor into said fuel chamber; and an inlet check value disposed in said fuel supply path between said bifurcation point and said fuel chamber.

47. A fuel supply system according to claim 46, further comprising a fuel pump operably coupled in said fuel supply passage so as to be located downstream of said fuel tank and upstream of said bifurcation point.

48. A fuel supply system according to claim 46, further comprising a plunger pump disposed in said fuel discharge apparatus body, said plunger pump comprising a cylinder mounted in said fuel discharge apparatus body, a plunger slidably disposed in said cylinder for reciprocating movement therein, and a solenoid coil disposed around said cylinder for actuating said plunger to slide within said cylinder; and wherein said reflux path extends in an axial direction of said plunger pump between said cylinder and said solenoid coil.

49. A fuel supply system according to claim 46, wherein said reflux path is connected to said fuel supply path at a bifurcation point in such a manner that said reflux path branches off from said fuel supply path at said bifurcation point and originates at said fuel supply path and leads from said fuel supply path to said fuel return outlet.

50. A fuel supply system according to claim 46, further comprising a fuel injection nozzle provided at said fuel discharge outlet.

51. A fuel supply system according to claim 50, further comprising a plunger pump disposed in said fuel discharge apparatus body and operably connected with said fuel chamber to pressurize fuel in said fuel chamber to thereby enable discharge of the fuel from said fuel discharge outlet through said fuel injection nozzle.

52. A fuel supply system according to claim 46, wherein said bifurcation point is disposed within said fuel discharge apparatus body.

53. A fuel supply system according to claim 46, wherein said vapor blocking member comprises a surface tension generating member.

54. A fuel supply system for an internal combustion engine, said fuel supply system including a fuel tank, a fuel discharge apparatus, a fuel supply passage connecting said fuel discharge apparatus to said fuel tank to enable supply of fuel from said fuel tank to said fuel discharge apparatus and a return passage connecting said fuel tank to said fuel discharge apparatus to enable return of excess fuel from said fuel discharge apparatus to said fuel tank, said fuel discharge apparatus comprising;

a fuel discharge apparatus body;

a fuel chamber defined within said fuel discharge apparatus body;

a fuel inlet fluidically connected to said fuel tank;

a fuel supply path at least partially defined by said fuel inlet and fluidically connected to said fuel chamber to supply fuel from said fuel tank to said fuel chamber;

a fuel discharge outlet fluidically connected to said fuel chamber for discharging fuel from said fuel chamber;

a fuel return outlet fluidically connected to said fuel tank via said return passage to allow return of excess fuel to said fuel tank;

a reflux path defined in said fuel discharge apparatus body and being fluidically connected between said fuel supply path and said fuel return outlet to allow flow of the excess fuel from said fuel supply path to said fuel return outlet, said reflux path being connected to said fuel supply path at a bifurcation point;

a vapor blocking member provided in said fuel supply path at said bifurcation point to block entry of vapor into said fuel chamber; and a plunger pump disposed in said fuel discharge apparatus body, said plunger pump comprising a cylinder mounted in said fuel discharge apparatus body, a plunger slidably disposed in said cylinder for reciprocating movement therein, and a solenoid coil disposed around said cylinder for actuating said plunger to slide within said cylinder;

wherein said reflux path extends in an axial direction of said plunger pump between said cylinder and said solenoid coil.

55. A fuel supply system according to claim 54, further comprising a fuel pump operably coupled in said fuel supply passage so as to be located downstream of said fuel tank and upstream of said bifurcation point.

56. A fuel supply system according to claim 54, wherein said reflux path is connected to said fuel supply path at a bifurcation point in such a manner that said reflux path branches off from said fuel supply path at said bifurcation point and originates at said fuel supply path and leads from said fuel supply path to said fuel return outlet.

57. A fuel supply system according to claim 54, further comprising a fuel injection nozzle provided at said fuel discharge outlet.

58. A fuel supply system according to claim 57, wherein said plunger pump is operably connected with said fuel chamber to pressurize fuel in said fuel chamber to thereby enable discharge of the fuel from said fuel discharge outlet through said fuel injection nozzle.

59. A fuel supply system according to claim 54, wherein said bifurcation point is disposed within said fuel discharge apparatus body.

60. A fuel supply system according to claim 54, wherein said vapor blocking member comprises a surface tension generating member.

61. A fuel supply system according to claim 54, further comprising a fuel pump operably coupled in said fuel supply passage so as to be located downstream of said fuel tank and upstream of said bifurcation point.

62. A fuel supply system according to claim 54, wherein said fuel return outlet is disposed vertically above said bifurcation point.

63. A fuel discharge apparatus according to claim 14, wherein said fuel return outlet is disposed vertically above said bifurcation point.

64. A fuel discharge apparatus according to claim 21, wherein said fuel return outlet is disposed vertically above said bifurcation point.

65. A fuel supply system according to claim 46, wherein said fuel return outlet is disposed vertically above said bifurcation point.

66. A fuel supply system according to claim 46, further comprising a fuel pump operably coupled in said fuel supply passage so as to be located downstream of said fuel tank and upstream of said bifurcation point.

* * * * *